US008220951B2

(12) United States Patent
Brydon, Jr.

(10) Patent No.: US 8,220,951 B2
(45) Date of Patent: Jul. 17, 2012

(54) PRIVACY LIGHT

(75) Inventor: Russell J. Brydon, Jr., Phoenix, AZ (US)

(73) Assignee: Privacy Light International Company, LLC, Wilmington, DE (US)

( * ) Notice: Subject to any disclaimer, the term of this patent is extended or adjusted under 35 U.S.C. 154(b) by 0 days.

(21) Appl. No.: 12/949,573

(22) Filed: Nov. 18, 2010

(65) Prior Publication Data

US 2012/0127701 A1 May 24, 2012

(51) Int. Cl.
*F21L 4/00* (2006.01)

(52) U.S. Cl. ..... 362/191; 362/249.11; 362/253; 362/269; 362/372; 362/145

(58) Field of Classification Search ..... 362/145, 362/157, 183, 188, 190–191, 194, 249.01, 362/249.07, 249.1, 249.11, 253, 257, 269, 362/277, 285, 317, 326, 351, 368, 370–372, 362/641

See application file for complete search history.

(56) References Cited

U.S. PATENT DOCUMENTS

| | | | | |
|---|---|---|---|---|
| 3,128,049 | A | 4/1964 | Maxim | |
| 3,203,052 | A | 8/1965 | Curtis, Jr. | |
| 3,944,336 | A * | 3/1976 | Carr, Jr. | 359/485.07 |
| 4,164,010 | A | 8/1979 | Finch | |
| 5,177,461 | A | 1/1993 | Budzyna et al. | |
| 6,060,838 | A | 5/2000 | Cantoni et al. | |
| 6,158,156 | A | 12/2000 | Patrick | |
| 6,182,402 | B1 | 2/2001 | Aalst | |
| 6,212,805 | B1 | 4/2001 | Hill | |
| 6,402,338 | B1 * | 6/2002 | Mitzel et al. | 362/154 |
| 6,753,056 | B1 | 6/2004 | Mizumoto | |
| 7,198,372 | B2 | 4/2007 | Aeling et al. | |
| 2003/0098056 | A1 | 5/2003 | Fronek et al. | |
| 2009/0103317 | A1 | 4/2009 | Steck et al. | |
| 2009/0284960 | A1 * | 11/2009 | Chien | 362/157 |

FOREIGN PATENT DOCUMENTS

WO WO 2009/024918 * 2/2009

OTHER PUBLICATIONS

International Search Report and Written Opinion in corresponding International Patent Application No. PCT/US11/28790 filed Mar. 17, 2011 entitled Privacy Light, 9 pages.

* cited by examiner

*Primary Examiner* — Stephen F Husar
*Assistant Examiner* — Meghan Dunwiddie
(74) *Attorney, Agent, or Firm* — Lewis and Roca LLP

(57) ABSTRACT

A lighting system includes a lighting unit and a mounting structure. The lighting unit is mounted adjacent to a window to shine outward, obstructing a view of the inside, while allowing those inside a clear, lighted view of the outside. The lighting unit may be powered by electrical wiring, battery, or solar. Light is preferably adjustable in various directions. The lighting system provides additional security and privacy.

11 Claims, 2 Drawing Sheets

PRIVACY LIGHT

BACKGROUND OF THE INVENTION

1. Field of the Invention

The present invention relates to lighting fixtures and, more specifically, to a light fixture mounted in a window to shine out in order to obstruct a view inside, while providing those inside a lit view outside.

2. The Prior Art

A number of trends have come together to make many people more concerned about their privacy. One trend is increasing wealth, which increases the desire for privacy. Another is that as people move around the country more often, they less often know their neighbors very well. This all comes together with people more and more interested in keeping others from looking through their windows into the house.

Traditionally, privacy in a house has been implemented through shutters, followed by curtains, and more recently, blinds and other window treatments. One disadvantage of these approaches to privacy is that the measures that they take to keep people from looking through windows from the outside typically makes it more difficult to see through the windows from the inside.

BRIEF SUMMARY OF THE INVENTION

A lighting system includes a lighting unit and a mounting structure. Light from the lighting unit is mounted adjacent to a window to shine outward, obstructing a view of the inside of a space such as a house, commercial space, car, boat, etc., while allowing those inside a clear, lighted view of the outside. The lighting unit may be powered by electrical wiring, battery, or solar. Light is preferably adjustable in various directions. The lighting system provides additional security and privacy.

DETAILED DESCRIPTION

Figure 1:
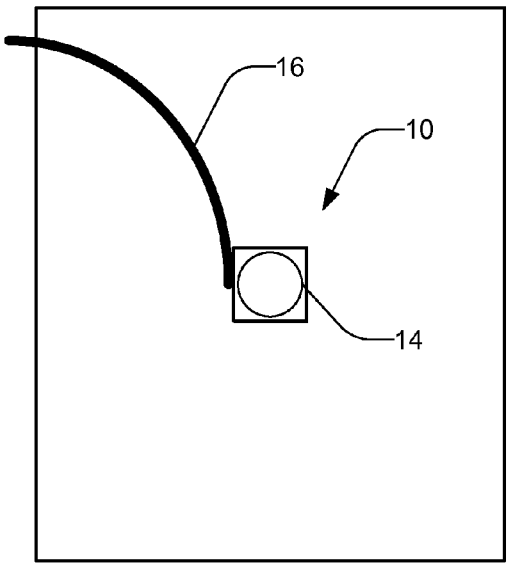
FIG. 1 is a diagram showing a front view of an adjustable light fixture mounted in a window, in accordance with one embodiment of the present invention.

FIG. 1 is a diagram showing a front view of an adjustable lighting system having a lighting unit 10 mounted in a window 12, in accordance with one embodiment of the present invention. The lighting unit 10 has a light source that is directed through a lens 14. The lighting system also includes a mounting arm 16. The lighting unit 10 is shown adjustably attached to the mounting arm 16 that mounts outside the window 12 frame to, for example, the wall, the window sill, the ceiling, or otherwise to allow the light source in the light fixture to direct light out through the window 12. In this embodiment, the lighting unit 10 attached to the mounting arm 16 may be adjustable as to direction. For example, the light may be adjusted up, down, right, or left. The lens may also be adjustable as to focus. This allows the light to be adjusted to maximize illumination at a specific distance, or be de-adjusted to minimize impacting neighbors. The light is typically mounted adjacent to the window 12 in order to minimize reflected glare from the light, while maximizing its ability to obstruct a view of the inside. Persons skilled in the art will appreciate that while illustrative embodiments are shown in the context of a house, the present invention is applicable to other enclosed spaces such as commercial buildings such as offices, automobiles and trucks, recreational vehicles, boats, etc.

The light source is typically electrically powered. This may be accomplished, for example, by running a wire down inside of or along side of the mounting arm 16 from a power source outside the window. Another alternative is to supply the electricity to the light source with batteries. In yet another embodiment, the light may ultimately be solar powered, with the light charging a battery during the day, and then utilizing the battery to power the light after dark. Other sources of power are also within the scope of the present invention. The lights may be turned on and off by electronic or electromechanical switches, timers, with a light sensor, or remotely, utilizing, for example, X10 technology which typically communicates over AC power lines within a home, or a combination of one or more of these techniques. Other methods of turning the lights on and off are also within the scope of the present invention.

The type of light source utilized may also vary with different embodiments of the present invention. The light source may be incandescent, fluorescent, LCDs, LEDs, or may be other light source types, currently available, or later invented. LCDs and LEDs are very attractive in this invention since they can produce significant glare without generating as much light shining into a neighbor's windows. Other types of lights are also within the scope of the present invention. The light source may have more than one level of brightness, such as a two-level system with a high and low brightness output. In one embodiment, the lights are relatively white in color, while in other embodiments, other light colors are utilized. Furthermore, a "mood light" may be mounted on the back of the light fixture to provide soft illumination in the room containing the light.

The light can be used on residential and commercial properties, recreational vehicles and tents. One or more lights can be placed on windows, doors (since many have windows on them to look through), and garage doors that often have windows on them. The shape of the light or lighting unit may be square, rectangular, triangular, or round. The light may also take the form of a pendulum; a light that is fixed on the ceiling or wall, which shines out of the window. Other shapes and configurations are also within the scope of the present invention.

Furthermore, the lighting system may include a security camera or other security device, either mounted separately or integrated into the lighting system. The focus of the lens 14, or other parameters such as the brightness of the light source, may be dynamically adjusted by the security system, for example, on command, or in response to a motion, heat, or other detector. The system may also provide an audible warning comprising either a verbal warning or other sound.

Figure 2:
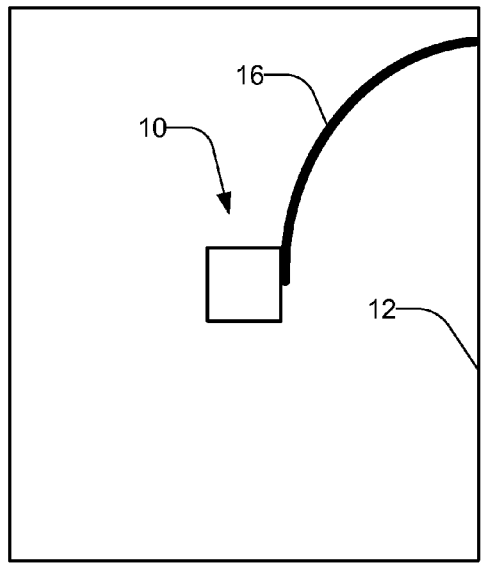
FIG. 2 is a rear view of the light fixture shown in FIG. 1.

FIG. 2 is a rear view of the lighting unit 10 shown in FIG. 1. The rear of the lighting unit is shown in a window 12, along with the mounting arm 16 from which the light source is attached.

Figure 3:
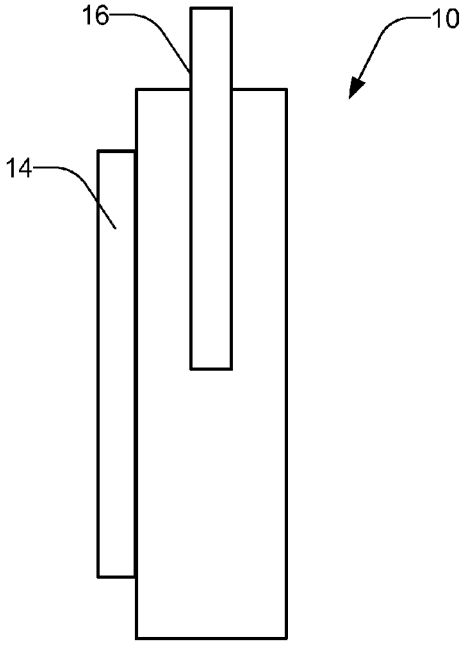
FIG. 3 is a side view of the light fixture shown in FIGS. 1 and 2.

FIG. 3 is a side view of the lighting unit 10 shown in FIGS. 1 and 2. The lighting unit 10 is shown supported by a mounting arm 16. Also shown in this FIG. is a lens 14 that may be adjustable in order to focus or unfocus the light being emitted by the light source.

Figure 4:
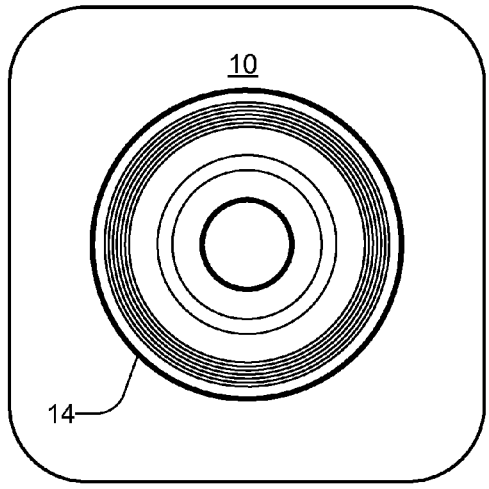
FIG. 4 is a front view of a light fixture, in accordance with another embodiment of the present invention.

FIG. 4 is a front view of a lighting unit 10, in accordance with another embodiment of the present invention. A lens 14 is shown attached to the front of the light source. The lens 14 may be adjustable in order to focus or unfocus the light being emitted by the light source.

Figure 5:
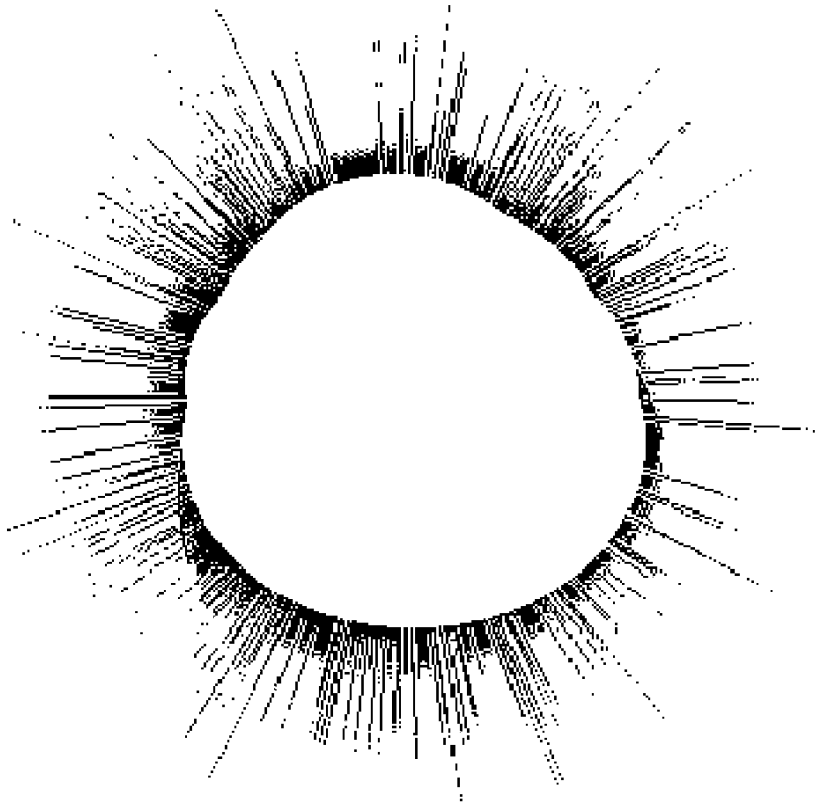
FIG. 5 is an exemplary view of the outside of a window looking in, with a light active.

FIG. 5 is an exemplary view of the outside of a window 12 looking in, with a light active. The light shown from the light source is somewhat unfocused in this FIG., in order to reduce the amount of light that might affect neighbors.

Figure 6:
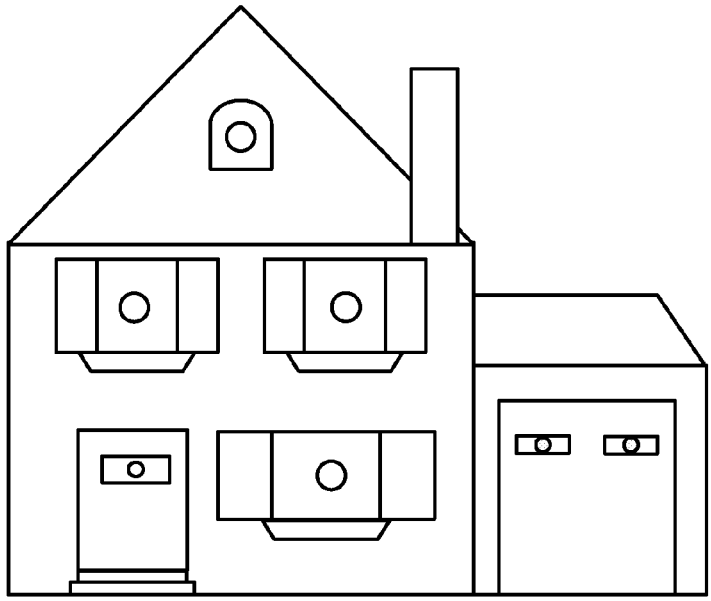
FIG. 6 is a diagram showing a house with four light fixtures emitting light, in accordance with one embodiment of the present invention.

FIG. 6 is a diagram showing a house with seven lighting systems emitting light, in accordance with one embodiment of the present invention. The lighting system is shown in four windows, the window in the front door, and in two windows in the attached garage. As can be seen in FIGS. 5 and 6, the present invention makes it difficult to see through a window into a house or business.

Those skilled in the art will recognize that modifications and variations can be made without departing from the spirit of the invention. Therefore, it is intended that this invention encompass all such variations and modifications as fall within the scope of the appended claims.

What is claimed is:

1. A lighting system comprising:

a mounting system positioned adjacent to an opening in a habitable structure;

a lighting unit including a light source attached to the mounting system and oriented to shine out of the opening, obstructing an ability to see in through the opening; and an adjustable lens optically coupled to the light source in the lighting unit allowing a focus of the light to be adjusted.

2. The lighting system in claim 1 wherein the light source is powered by electricity.

3. The lighting system in claim 2 wherein the electricity is supplied by house electrical current.

4. The lighting system in claim 2 wherein the electricity is supplied by at least one battery.

5. The lighting system in claim 2 wherein the electricity is supplied by solar power.

6. The lighting system in claim 1 wherein the lighting unit is adjustable in at least one direction.

7. The lighting system in claim 1 wherein the opening contains a window and the lighting unit is mounted in the window of a room facing outwards obscuring a view into the room through the window from outside the room.

8. The lighting system in claim 7 wherein the lighting unit is mounted in contact with the window.

9. The lighting system in claim 8 wherein the mounting system attaches the lighting unit to the window.

10. The lighting system in claim 9 wherein the lighting unit is attached to the window utilizing at least one from a set consisting of: glue and a suction device.

11. The lighting system in claim 8 wherein the window has at least two panes and the lighting unit is embedded between the at least two panes.

* * * * *